US012275496B1

(12) United States Patent
Meyer

(10) Patent No.: US 12,275,496 B1
(45) Date of Patent: Apr. 15, 2025

(54) SAFETY RAILING SYSTEM FOR A HOPPER BARGE

(71) Applicant: Eric C. Meyer, Fenton, MO (US)

(72) Inventor: Eric C. Meyer, Fenton, MO (US)

( * ) Notice: Subject to any disclaimer, the term of this patent is extended or adjusted under 35 U.S.C. 154(b) by 429 days.

(21) Appl. No.: 17/832,988

(22) Filed: Jun. 6, 2022

Related U.S. Application Data

(60) Provisional application No. 63/208,685, filed on Jun. 9, 2021.

(51) Int. Cl.
*B63B 17/04* (2006.01)

(52) U.S. Cl.
CPC ..... *B63B 17/04* (2013.01)

(58) Field of Classification Search
CPC ..... B63B 17/00; B63B 17/04; B63B 17/045
USPC ..... 114/343, 364
See application file for complete search history.

(56) References Cited

U.S. PATENT DOCUMENTS

| | | | | |
|---|---|---|---|---|
| 3,860,089 | A | 1/1975 | Huggett | |
| 4,077,350 | A * | 3/1978 | Nishino | B63B 25/006 414/142.8 |
| 5,581,955 | A | 12/1996 | Gleave | |
| 6,748,892 | B1 * | 6/2004 | Rochfort | B63B 3/06 114/266 |
| 8,397,866 | B2 | 3/2013 | Townend et al. | |
| 8,672,091 | B2 | 3/2014 | Rainey et al. | |
| 8,893,852 | B2 | 11/2014 | Liggett | |
| 8,978,821 | B2 | 3/2015 | Galpin et al. | |
| D902,318 | S * | 11/2020 | Anderson | D21/317 |
| D957,305 | S * | 7/2022 | Anderson | D25/38.1 |
| D960,809 | S * | 8/2022 | Anderson | D25/38.1 |
| 2017/0281994 | A1 | 10/2017 | Burke | |

FOREIGN PATENT DOCUMENTS

| | | | |
|---|---|---|---|
| DE | 3728282 | A1 | 3/1988 |
| DE | 102008006611 | B3 | 6/2009 |
| GB | 1571385 | A | 7/1980 |
| GB | 2193993 | B | 1/1991 |
| WO | 2013002160 | A1 | 1/2013 |
| WO | 2015092370 | A1 | 6/2015 |

* cited by examiner

*Primary Examiner* — Daniel V Venne
(74) *Attorney, Agent, or Firm* — Grace J. Fishel

(57) ABSTRACT

A safety railing system for a hopper barge with a toadstool shaped handrail section attached to the vertical gussets of a coaming of the hopper barge. The handrail section has a hollow head and a hollow stem with a bottom orifice and spaced apart slots long the handrail section. A carrier configured for attachment to a safety lanyard has an anchor at a first end that passes through one of the slots into the hollow stem but not through the orifice of the stem. A bracket latches onto the handrail section and is attached to one of the vertical gussets. Handrail sections may be linked together end to end and are straight or curved.

10 Claims, 6 Drawing Sheets

SECTION 3-3

SAFETY RAILING SYSTEM FOR A HOPPER BARGE

BACKGROUND OF THE INVENTION

Field of the Invention

The present invention relates to a safety railing system which is designed to substantially reduce the risk of a worker falling overboard from the deck of a hopper barge or dock. The railing doubles as a handrail and provides an anchorage for the arrest of personnel.

Brief Description of the Prior Art

Falling overboard from a barge or a dock often results in a fatality. This happens numerous times each year in the marine industry. A hopper barge 10 is shown in FIG. 13 of the attached drawings with a coaming A which extends above the deck. The coaming A is supported by vertical gussets B. The walkway between the coaming and edge of the deck is between 24 and 30 inches and is typically slippery due to the presence of water, ice or spilled grain/other debris. Numerous obstructions are also present on the deck's edge including mooring fittings, manholes and the coaming support structure. Workers who must transit the edge of a barge risk falling into a river or between the barge and a dock. This poses a true safety risk.

Fall assist and fall arrest systems are common place in many industries. Although numerous designs exist, they are not easily adaptable to the requirements of the marine industry. Many fall assist/arrest systems are designed as an enclosed track with the trolley locked into the rail. This precludes a barge user the ability to enter/exit the barge at any point on its perimeter, which is required for barge, or similar type, operations. Such systems are described in U.S. Pat. Nos. 8,397,866, 8,672,091 and 5,581,955. Other prior art systems are designed to have the rail embedded in building structure, as in U.S. Pat. Nos. 3,860,089 and 5,581,955. U.S. Pat. No. 8,978,821 provides for a specific type of trolley that allows a user to move along an overhead rail after a fall. U.S. Pat. No. 8,893,852 provides for a different specific type of trolley for use on training/recreational types of equipment. US 2017/0281994 provides for speed control while transiting a rail and speed control during a fall.

BRIEF SUMMARY OF THE INVENTION

In view of the above, it is an object of the present invention to provide a safety railing system including a track integral with a handrail, a carrier with a sliding attachment to the track on one end and adapted for attachment to a safety harness on the other end providing a secure anchorage for one or more workers. It is another object to provide a safety railing system that may be mounted to the coaming, or other similar structure, of existing or new barges. It is another object to provide a safety railing system whose carrier can be attached or removed essentially at any point in the system allowing maximum flexibility for users to enter or exit the system. Other objects and features of the invention will be in part apparent and in part pointed out hereinafter.

In accordance with the invention, a safety railing system is provided that allows a user to travel along the edges of a barge, or similar structure. The system prevents the user from falling overboard but does not completely stop the user from contacting the deck in the event of a fall. The system includes a safety rail attached to the coaming, or other similar structure, around the sides and ends of a barge. The rail can be either integral with or independent from the barge structure. Independent rail sections can be placed together to form an enclosed loop around the perimeter of the barge, or other similar structure. Rail sections can be straight or curved. The rail sections can be supported by brackets that slidingly attach to the rail on one end and are attached to the coaming, or other structure, on the other end. The bracket can be bolted, welded or otherwise attached to the structure. The carrier attaches to the rail at intervals of approximately six feet. The attachment can be via openings in the track portion of the rail. The carrier is attached to a safety harness for securing a worker to the safety rail. Multiple carriers may be utilized at the same time. The rail serves as a grab hold in addition to a track for the carrier.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 13:
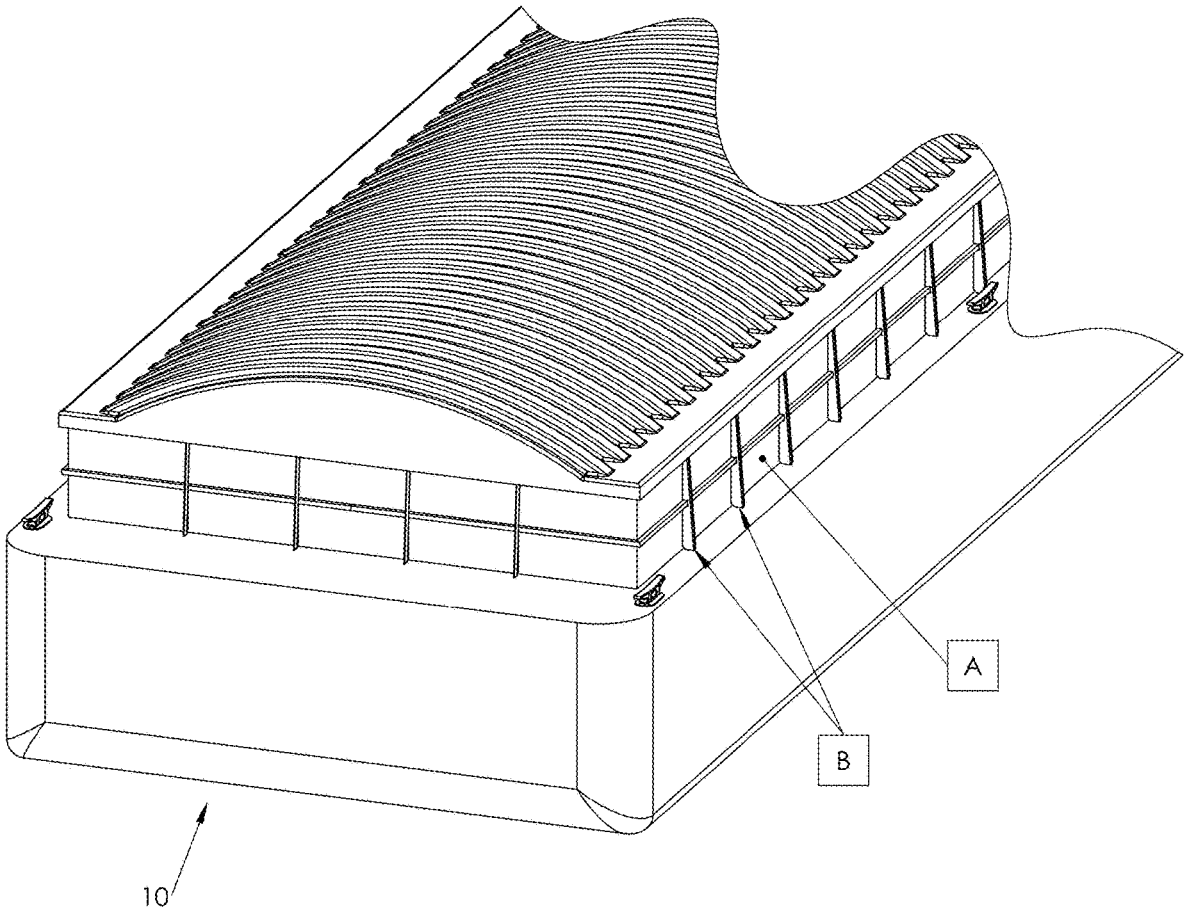
Fig.13 PRIOR ART
FIG. 13 is a prior art perspective view showing a hopper barge with longitudinal coaming along the sides and transversely opposing coaming along the ends.

Personnel safety apparatus for use on barges, or similar structures, is disclosed which prevents the user from falling overboard. The barge has no existing railing system or other means to keep personnel from falling overboard. Personnel must access all edges of the barge during normal operations. Additionally, during normal operations, personnel must enter or exit the barge at any given point on its perimeter as it may be moored to a dock, anchored in a river or combined with other barges in tow. Referring to the drawings more particularly by reference numbers, reference numeral 10 as shown in FIG. 13 identifies a hopper barge with a longitudinal coaming A along the sides and a transversely opposing coaming along the ends. Longitudinal and transverse coaming A is support by vertical gussets B.

A safety railing system 12 in major part comprising a rail 14 and a safety harness carrier 16 attached to the rail. On hopper barge 10, rail 14 may be attached with brackets 18 to gussets B provided along the longitudinal coamings, along the transversely opposing coamings but preferably around the entire coaming structure. Rail 14 may be formed as one continuous rail or as shown in the drawings in sections, some of which are straight 19 and others of which are curved 20. Sections 19, 20 may be cut to length in the field and spliced together as described below. Rail 14 is formed of any material suitable for the purpose, for example, but not limited to, a suitable metal, an alloy or a resilient polymeric material that is capable of supporting the weight of a worker as a handrail and as an anchor as more particularly described below.

Figure 1:
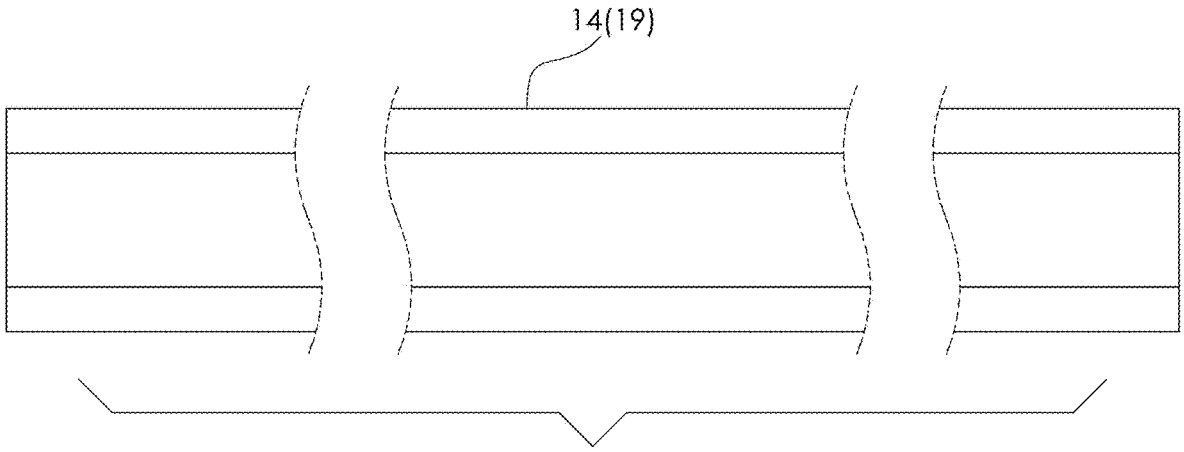
FIG. 1 is plan view of a straight rail section of indefinite length.
Figure 2:
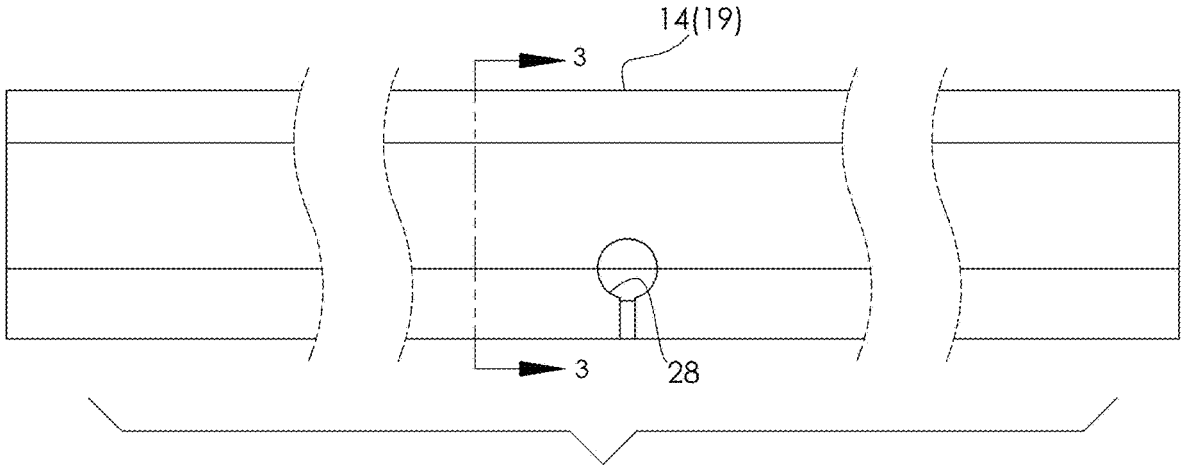
FIG. 2 is a side view of the straight section.
Figure 3:
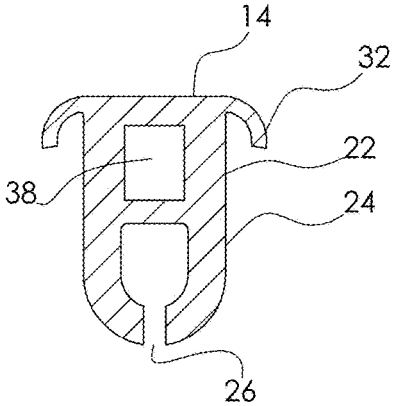
FIG. 3 is a cross-section taken along the plane of 3-3 in FIG. 2.
Figure 4:
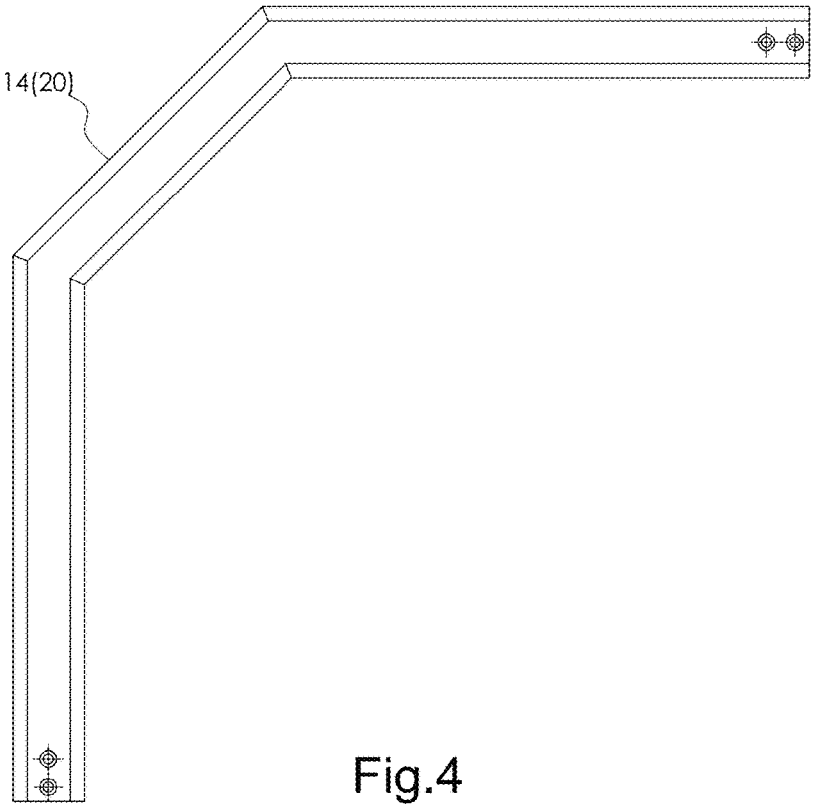
FIG. 4 is a plan view of a curved rail section.
Figure 5:
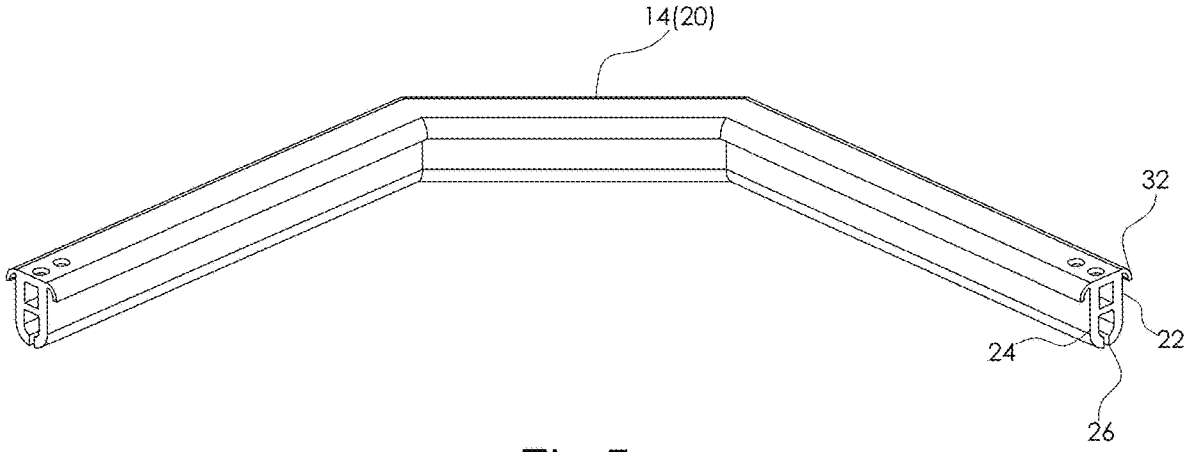
FIG. 5 is a perspective view the curved rail section.
Figure 12:
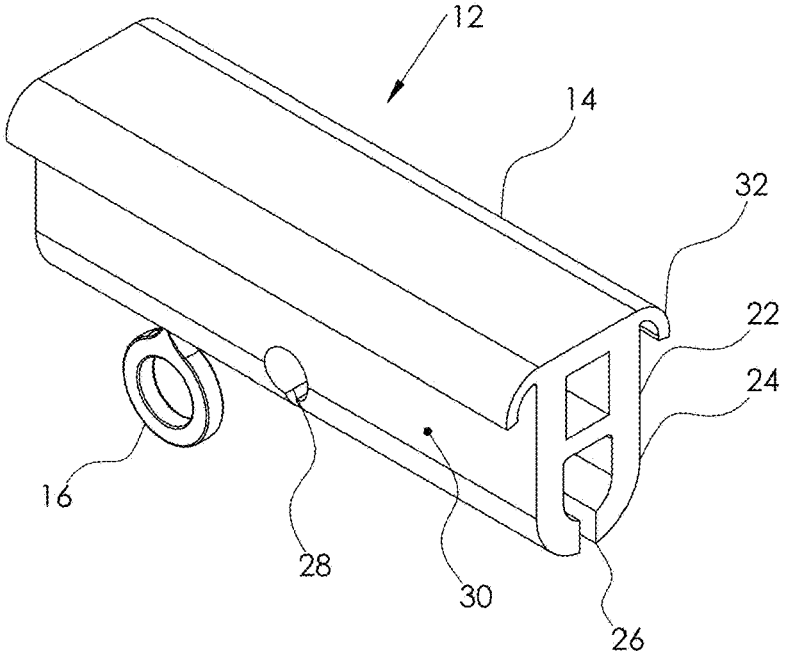
FIG. 12 is a perspective view of the carrier with the anchor slid inside the rail which serves as a track.

As best seen in FIG. 3, rail 14 is toadstool shaped in cross section with at least a partially hollow head 22 and a hollow stem 24. The shape of the hollow head 22 provides a handrail utility to the rail allowing for additional safety for personnel as they walk along the deck edge. Additionally, the shape of the hollow head 22 provides interlocking shape for attaching support bracket 18. Stem 24 is necked down into an orifice 26 of reduced diameter creating the track portion of the rail for the carrier 16 to travel on. Turning then to FIG. 12, slots 28 are formed in a sidewall 30 of stem 24 at spaced intervals along rail 14. Slots 28 allow for the carrier 16 to enter/exit the rail at repeatably spaced intervals, approximately six feet (one arm's length). Hollow head 22 is capped with downwardly extending rims 32.

Safety harness carrier 16 includes an anchor 34 at a first end and is configured for attachment to a lanyard at a second end. The lanyard, in turn, is for attachment to a worker's safety harness. The lanyard being of such a length as to prevent the user from falling overboard or off the dock. Anchor 34 is shaped and sized such that it passes through one of slots 28 and be slid inside stem 24 which serves as a track. As illustrated anchor 34 is globular in configuration but may have other shapes. Carrier 16 is formed of any material suitable for the purpose, for example, but not limited to, a suitable metal, an alloy or a resilient polymeric material that is capable of supporting the weight of a worker as an anchor.

Figure 6:
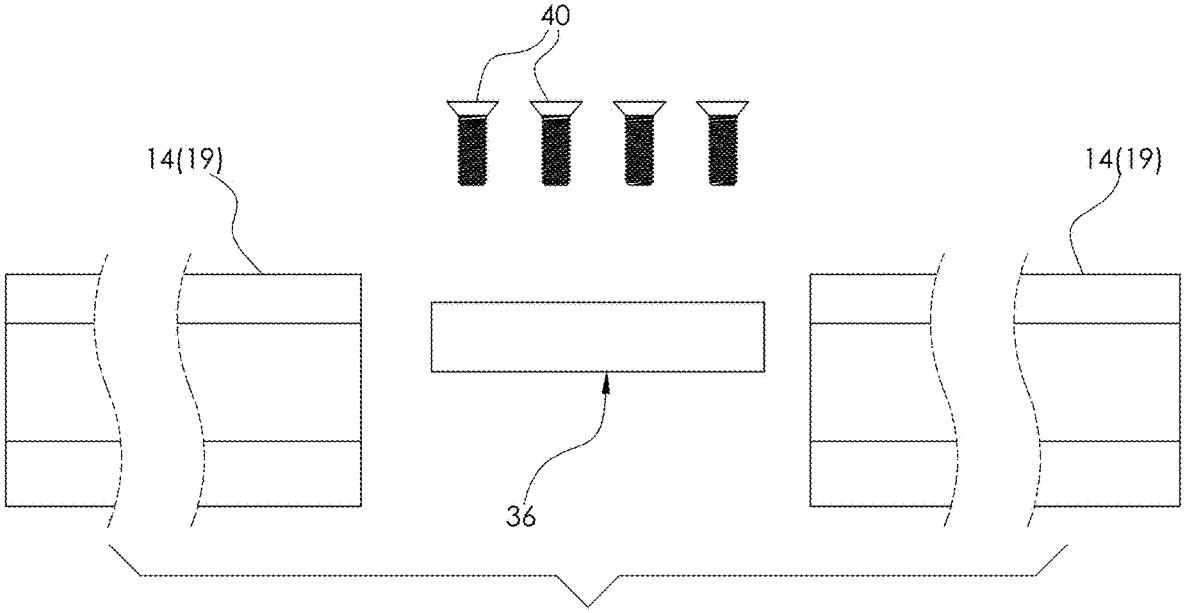
FIG. 6 is a side view of a key shown connecting adjacent rail sections.
Figure 7:
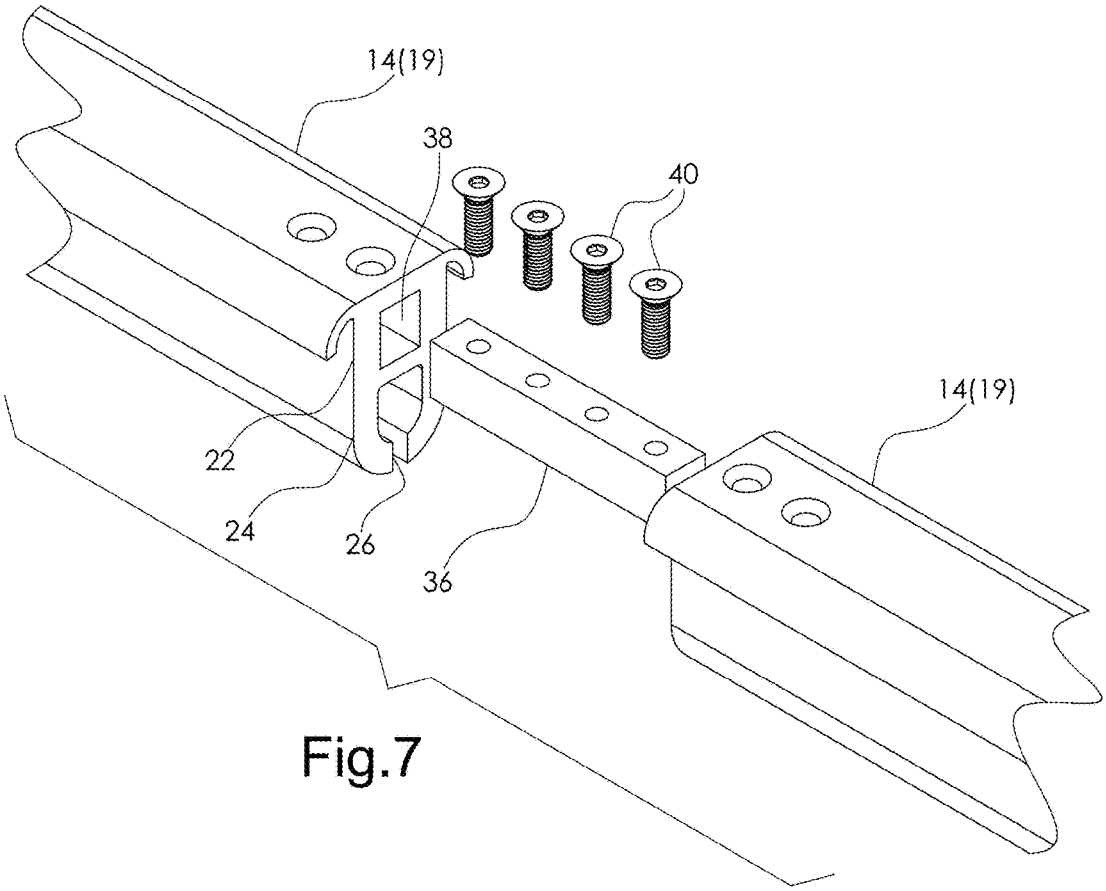
FIG. 7 is a perspective view of the key connecting adjacent rail sections.

Rail sections may be joined by several methods. One such method is as shown in FIGS. 6 and 7. Sections 19, 20 of rail 14 may be linked together with a key 36 which is received in a cooperatively shaped cavity 38 of the partially hollow head 22. Fasteners 40 such as screws or the like may be used to secure key 36 in sections 19,20 through aligned holes.

Figure 8:
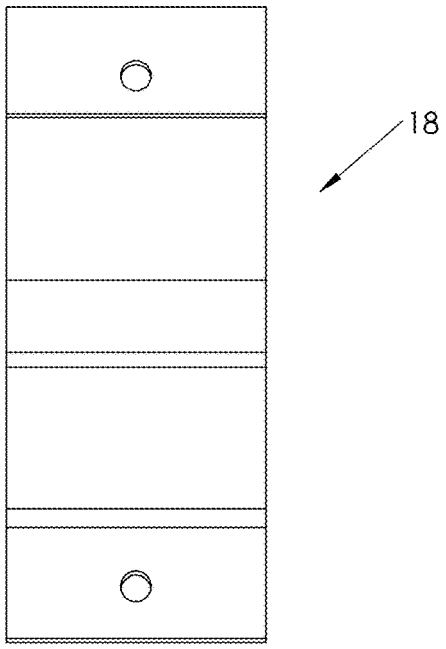
FIG. 8 is a front view of an adapter for attached the railing to the coaming.
Figure 9:
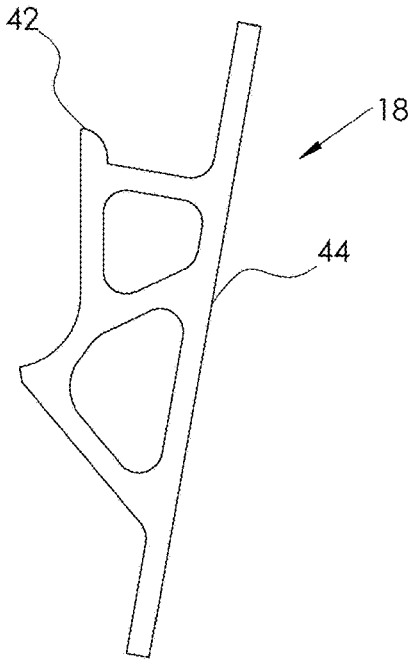
FIG. 9 is a side view of the adapter.
Figure 10:
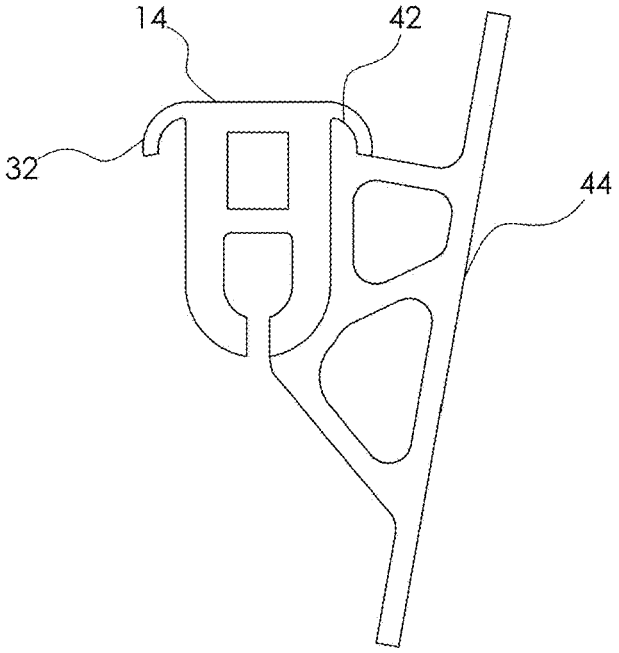
FIG. 10 is side view of the adapter with rail connected.
Figure 11:
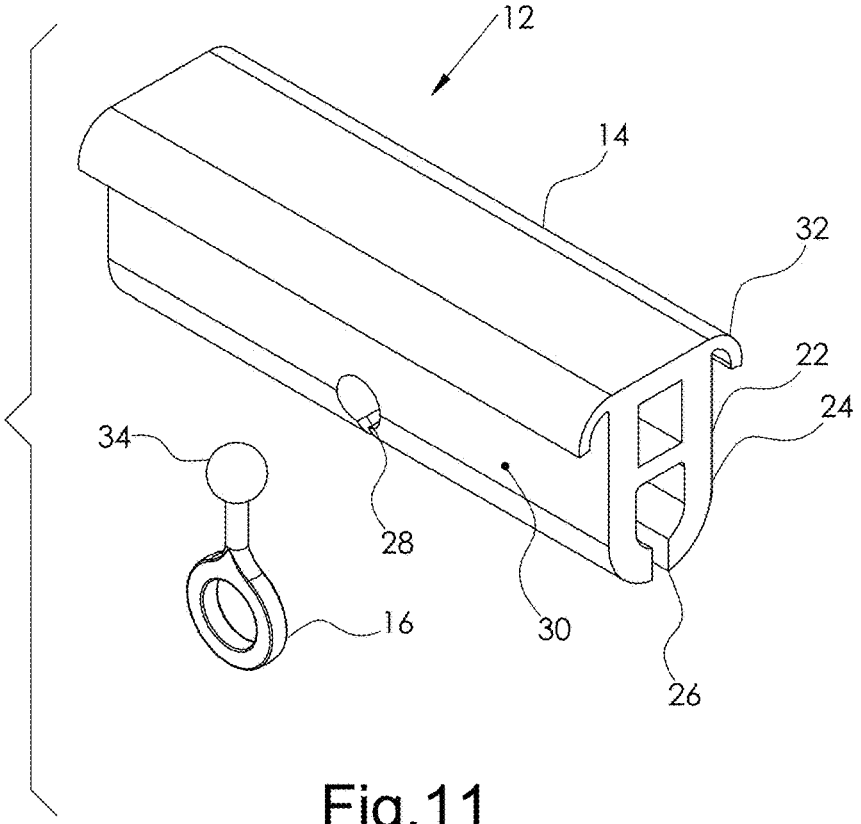
FIG. 11 is a perspective view of a carrier with an anchor prior to inserting the anchor through a slot in the rail.

Safety railing system 12 may be welded to the coamings A or gussets B or attached with a bracket 18 as illustrated in FIGS. 8-9. It is important that safety railing system 12 and the supporting structure and attachments be capable of withstanding the required design loads required for such apparatus. In the form illustrated, bracket 18 includes a crook 42 which latches into rim 32 of head 22 of rail 14 and is attached to a staff 44 which may be bolted, welded or the like to the coamings or gussets. Different brackets 18 may be provided to accommodate different coaming structures. The interface between brackets 18 and the supporting structure must be such that dissimilar metal materials do not come into direct contact. For that purpose, a suitable isolation material may be used.

With a combination of straight 19 and curved sections 20, the system may be installed in numerous different configurations including a straight line system, slightly offset, L or U shaped systems. Additionally, and most importantly, fully enclosed loop systems can be created.

With safety railing system 12 properly installed carrier 16 moves freely along rail 14. Because orifice 26 in rail 14 is directed downwardly any water splashed onto the deck or dock will drain out and corrosion is usually not a problem. From time to time, rails 14 and brackets 40 may need occasional cleaning. This may be accomplished with a soft bristle brush and mild household detergent and water. After which, the parts should be rinsed with fresh water. Aggressive cleaning fluids, acids, and other similar items should be kept away from the system.

While the system is substantially maintenance free, safety railing system 12 should be inspected at regular intervals. This includes verifying that rail 14 is secured to the coaming or dock by pulling on the rail and visually examining that the structural support brackets 18 and splices 36 between sections 19, 20 are secured tight.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A safety railing system for a hopper barge comprising
a toadstool shaped rail section with at least a partially hollow head and a hollow stem,
said partially hollow head having a keyway configured for receipt of a key linking adjacent rail sections together and a cap with downwardly extending rims,
said hollow stem having an orifice of reduced diameter at a bottom end and slots positioned in a first sidewall at spaced intervals along the rail sections and opening into the hollow stem; and,
a carrier having an anchor at a first end adapted to pass through one of the slots into the hollow stem but not through the orifice of the stem, said carrier adapted to be connected to a lanyard at a second end.

2. The safety railing system of claim 1 further comprising a bracket having a crook that latches under one of the downwardly extending rims of the cap and a support staff configured for attachment to a barge gusset or dock post.

3. The safety railing system of claim 2 wherein the bracket cups the rail section along a second sidewall of the stem below the crook.

4. The safety railing system of claim 1 wherein the key is cooperatively shaped for receipt in the keyway of the hollow head, said cap of the hollow head having at least one aperture at an end of the rail section in communication with the keyway, said key having at least one aperture for receipt of a fastener for locking the key in the keyway when the aperture in the hollow head and the aperture in the key are in alignment.

5. A safety railing system for a hopper barge comprising
a toadstool shaped handrail section attached to a vertical gusset of a coaming of the hopper barge,
said toadstool shaped handrail section having at least a partially hollow head and a hollow stem,
said partially hollow head having a keyway configured for receipt of a key linking adjacent handrail sections together and a cap with downwardly extending rims,
said hollow stem having an orifice of reduced diameter at a bottom end and slots positioned in a first sidewall at spaced intervals along the handrail sections and opening into the hollow stem;

a carrier having an anchor at a first end adapted to pass through one of the slots into the hollow stem but not through the orifice of the stem, said carrier adapted to be connected to a lanyard at a second end; and, a bracket having a crook that latches under one of the downwardly extending rims of the cap and a support staff configured for attachment to a barge gusset.

6. The safety railing system of claim 5 wherein the bracket cups the handrail section along a second sidewall of the stem below the crook.

7. The safety railing system of claim 5 wherein the key is cooperatively shaped for receipt in the keyway of the hollow head, said cap of the hollow head having at least one aperture at an end of the handrail section in communication with the keyway, said key having at least one aperture for receipt of a fastener for locking the key in the keyway when the aperture in the hollow head and the aperture in the key are in alignment.

8. The safety railing system of claim 5 wherein the toadstool handrail section is straight.

9. The safety railing system of claim 5 wherein the toadstool handrail section is curved.

10. The safety railing system of claim 5 wherein the bracket and the barge gusset are formed of compatible metals or alloys or are separated by an isolation material.

* * * * *